United States Patent [19]

Costa et al.

[11] Patent Number: 4,794,391

[45] Date of Patent: Dec. 27, 1988

[54] DISPLAY MATRIX INCORPORATING LIGHT-CONDUCTING FIBERS AND LIGHT-OCCULTING SHUTTERS

[75] Inventors: Richard Costa, Paris; Michel Batt, Tours; Roland Gassmann, Saone, all of France

[73] Assignee: Securite et Signalisation, Tours Cedex, France

[21] Appl. No.: 922,959

[22] Filed: Oct. 24, 1986

Related U.S. Application Data

[63] Continuation-in-part of Ser. No. 547,380, Oct. 31, 1983.

[51] Int. Cl.[4] ..... G08B 5/00

[52] U.S. Cl. ..... 340/815.31; 340/763; 340/764; 340/815.08

[58] Field of Search ..... 350/311, 315, 317; 340/815.08, 815.31, 815.03, 815.04, 815.05, 815.07, 763, 764, 783, 702

[56] References Cited

U.S. PATENT DOCUMENTS

| | | | |
|---|---|---|---|
| 2,038,831 | 4/1936 | Erlach | 350/317 |
| 2,493,770 | 1/1950 | Manning | 350/315 |
| 3,118,138 | 1/1964 | Milas et al. | 340/815.04 |
| 3,208,339 | 9/1965 | Tiffenberg et al. | 350/315 |
| 3,479,512 | 11/1966 | Weissenberg | 350/315 |
| 3,515,800 | 6/1970 | Ebihara et al. | 350/315 |
| 3,636,557 | 1/1972 | Watkins | 340/815.08 |
| 3,781,876 | 12/1973 | McComb | 340/815.08 |
| 4,279,089 | 7/1981 | Murakauri | 340/815.31 |
| 4,344,070 | 8/1982 | Forest | 340/815.08 |

FOREIGN PATENT DOCUMENTS

| | | | |
|---|---|---|---|
| 19225 | of 1892 | United Kingdom | 340/815.08 |

*Primary Examiner*—Marshall M. Curtis
*Assistant Examiner*—R. Bowler
*Attorney, Agent, or Firm*—Stephen F.K. Yee

[57] ABSTRACT

A display matrix incorporates optical fibers to transmit light from light sources to the front of the display. An occulting device is associated with an assembly of fibers to modify the character of the light emitted to the front of the matrix, and a device controlling the actuation of the occulting of device makes it possible selectively to control the occulting of determined groups of fibers to transform the display as desired. The occulting device comprises a disc incorporating different light-modifying sectors capable of being interposed in the path of the light, as a function of a rotation controlled by the electromechanical actuation device which includes a rotor coupled to the disc and rotatable within a stator made of a material having good magnetic remanence and high permeability to provide the device with a very short response time and low input energy requirement.

8 Claims, 3 Drawing Sheets

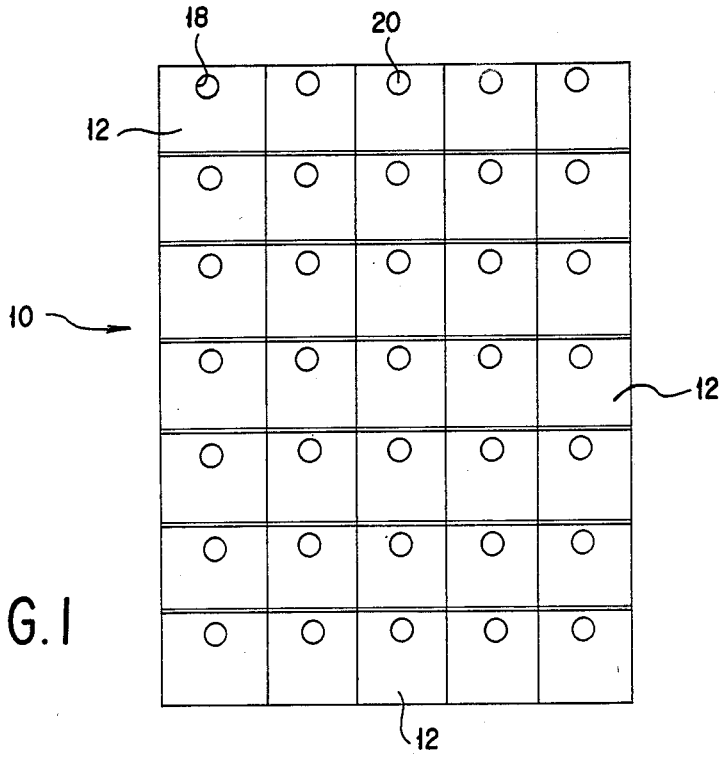
FIG. 1
FIG. 2
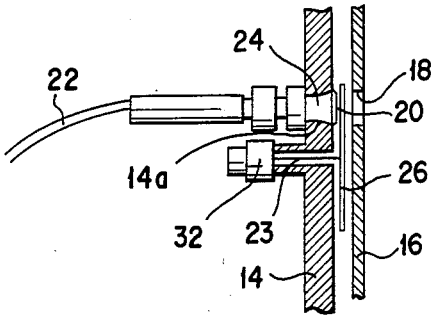
FIG. 4
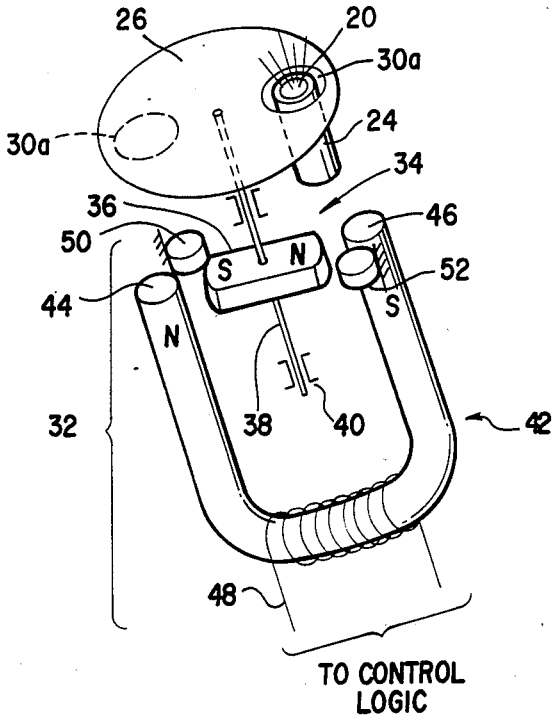

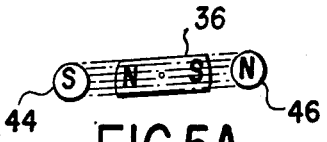
FIG.5A
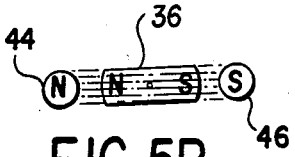
FIG.5B
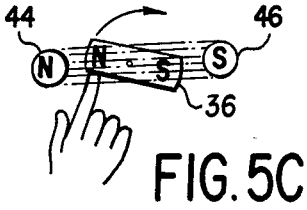
FIG.5C
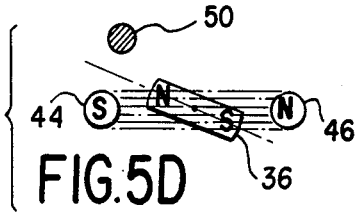
FIG.5D
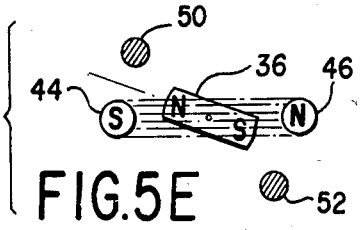
FIG.5E
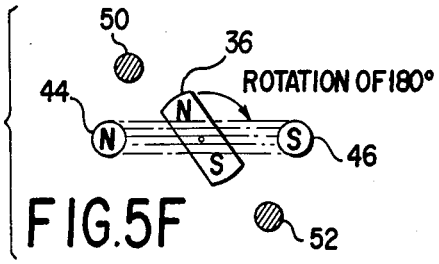
FIG.5F
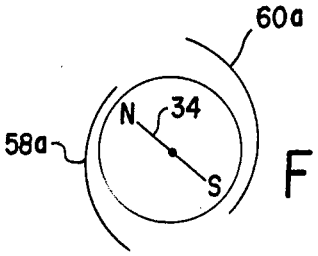
FIG.8A
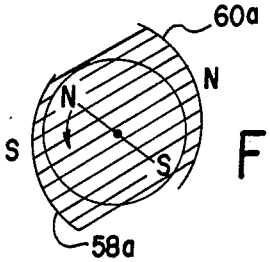
FIG.8B
FIG.8C
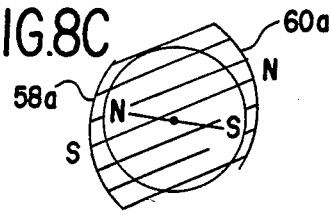
FIG.8F
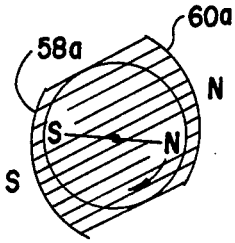
FIG.8D
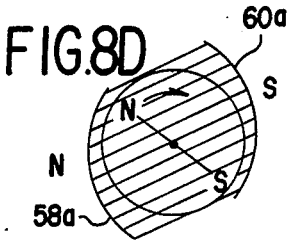
FIG.8G
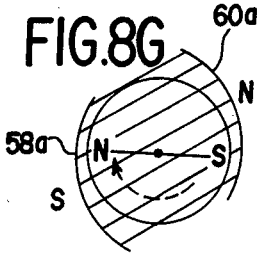
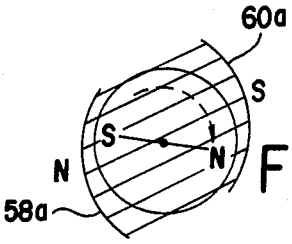
FIG.8E

DISPLAY MATRIX INCORPORATING LIGHT-CONDUCTING FIBERS AND LIGHT-OCCULTING SHUTTERS

CROSS-REFERENCE TO RELATED APPLICATION

This application is a continuation-in-part of pending application Ser. No. 547,380, filed 31 Oct. 1983.

BACKGROUND OF THE INVENTION

1. Field of the Invention

The present invention relates to a display matrix incorporating an assembly of light-transmitting optical fibers and, more particularly, relates to such matrix having selectively operable control means to regulate light passage from the optical fibers to the display.

2. The Prior Art

Several types of technology are known to exist for making display panels with variable messages, intended primarily for road use.

Prisms have been used in such panels which enable two messages and a blank surface to be displayed. Panels have been constructed from matrices of dots which display messages in alphanumeric and graphic symbols. Matrices are versatile since the number of possible messages is practically unlimited.

Matrix type display panels may be of the active type, such as matrices of lamps, electroluminescent diodes, plasmas, etc., or the passive type, such as matrices with magnetically-operated elements. These types of systems have disadvantages. Matrices incorporating lamps are heavy and require substantial supports. Systems incorporating diodes and plasma are difficult to see in daylight and may be washed out by bright sun or artificial light. The passive systems do not always provide the desired visual impact and limits the display of colors.

Systems incorporating optical fibers, or light conductors, provide a very strong visual impact, even under adverse conditions, such as fog, rain, light glare, etc., and therefore have proven advantageous. Moreover, optical fibers enable messages to be displayed in any desired color. However, the number of possible messages are limited by the construction of such systems, and generally can not exceed six or seven different messages.

German Patent Application No. DE-A-2 831 174 discloses a display matrix of the above type in which the optical fibers associated with occulting devices interposed in the path of the light between a light source and the front of the matrix and is capable of modifying the color and/or intensity of the light emitted to the front of the matrix. Devices controlling the occulting devices make it possible selectively to control occultation of determined groups of fibers to change the display as desired.

Occulting devices of the prior art have included the optoelectronic type, such as liquid crystals, etc. As an example, U.S. Pat. No. 3,909,823, issued to Knowlton, discloses the use of a liquid organic crystal material as a light shutter. These devices, however, have not been satisfactory for applications to displays on roads and highways. On one hand, these devices have been highly susceptible to operational disturbances due to very low temperatures in winter and high temperatures when they are exposed to the sun. On the other hand, since optoelectronic devices never completely occult the light, the displayed messages are blurry and imperfectly defined.

The occulting devices of the prior art have also included electromechanical types, such as blocking screens moved in translation by jacks, or pivoting shutters or valves controlled by electromagnets, such as disclosed in U.S. Pat. Nos. 3,140,553, to Taylor and 4,040,193, to Matsuda et al. In the first case, the lateral dimensions are relatively large and, when used with optical fibers, do not permit the close downstream grouping of the fibers which is necessary for good luminosity of the display. In the second case, the slightest interruption of current causes all the valves to collapse, thus erasing the message. In both cases, the system is noisy and, moreover, permits only two positions: occultation or the absence of occultation. It does not permit variable messages in several colors to be made on the same matrix, which is necessary for representing certain road signs.

Another serious disadvantage of the prior-art electromechanical types of occulting devices is their relatively long response time, typically in excess of 1 ms. Due to the large number of matrix elements customarily used to form a display, the long time required by each occulting device to respond to a control signal to change its state of occultation results in an excessively long time to create or change a message.

SUMMARY OF THE INVENTION

It is an object of the invention to provide a display matrix employing light-conducting fibers which enables a virtually unlimited number of messages to be displayed, and incorporating electromechanical occulting devices which do not present the drawbacks of the known matrices.

This object is attained according to the invention by providing occulting devices constituted by discs having different light-modifying sectors capable of being interposed in the path of the transmitted light, as a function of a rotation controlled by a control device. Each disc is driven by a motor having two positions of equilibrium, with the rotation being controlled by current pulses supplied by the control device. The light-modifying sectors may consist of free openings, colored filters, or solid portions. If it is desired to place more than two occulting sectors on a disc, reduction gearing may be provided to reduce the angular rotation of the disc by the motor.

The motor comprises a rotor rotating freely about an axis oriented perpendicularly with respect to the disc and is constituted by a small permanent magnet with two poles oriented radially with respect to the rotational axis. A stator made of material having good magnetic remanence forms a circuit magnetizable by pulses from the control device, and presents two poles diametrically opposite with respect to the axis of the rotor. Near each stator pole is a stationary indexing element of a magnetically-attractive material which, upon deenergization of the motor, causes the rotor to stop in a position non-aligned with the stator poles. This non-aligned orientation assists in initiating rotor rotation at the moment a pulse energizes the stator.

The occulting device may be disposed at the upstream end of the optical fibers, which allows considerable freedom in the sizes of the characters appearing on the face of the display panel. However, it may be more advantageous, particularly because of reduced bulk, to place the occulting device just in front of the downstream end of the fibers.

BRIEF DESCRIPTION OF THE DRAWINGS

The invention will be more readily understood from the following description and reference to the accompanying drawings.

FIG. 1 is a front view of a display panel element.

FIG. 2 shows, partly in section, the end of a light conductor and the occulting disc associated therewith.

FIG. 4 is a perspective view of one embodiment of a motor for operating an occulting disc.

FIGS. 5*a*–5*f* illustrate the operation of the motor of FIGS. 4 and 6.

FIGS. 8*a*–8*g* illustrate the operation of the motor of FIG. 7.

DESCRIPTION OF THE PREFERRED EMBODIMENTS

Figure 3:
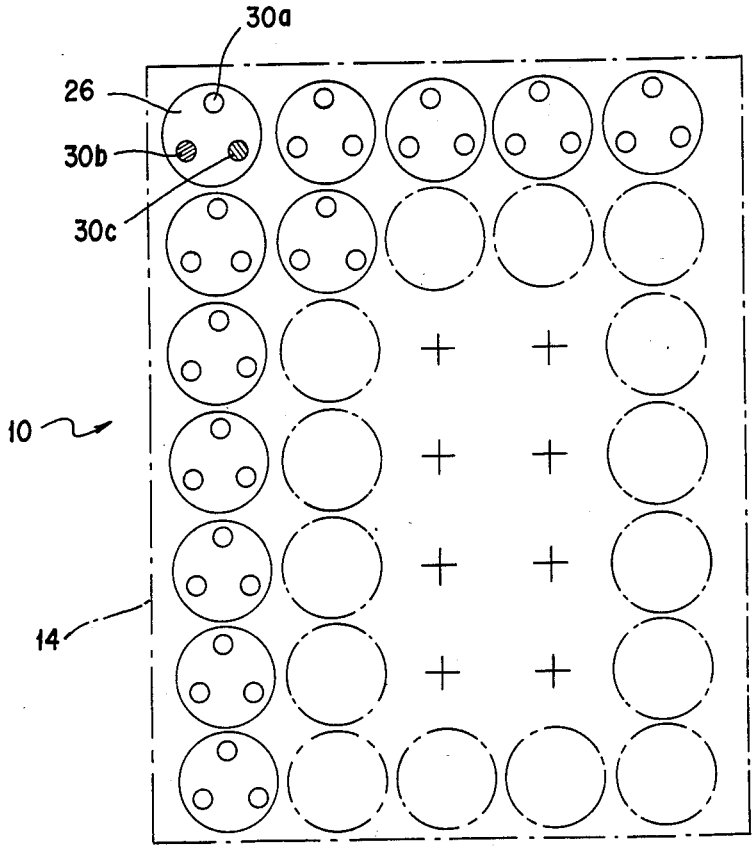
FIG. 3 is a front view of the element of FIG. 1, with the protective panel removed to reveal the occulting discs.

Referring now to the drawings, FIG. 1 shows an element or section 10 of a display panel in the form of a matrix of 7×5 cells 12, measuring 105 mm high and 75 mm wide. A complete display panel would comprise a plurality of elements 10. As shown in FIG. 2, display panel element 10 includes a support plate 14, perforated with a plurality of spaced bores 14*a*, and a parallel-disposed protective or face plate 16 provided with a plurality of apertures 18 having centers which are coincident with the bores 14*a*. The downstream or display end 20 of a light conductor 22, consisting of optical fibers (not shown), terminates in each cell 12, and is fixed by a conventional endpiece 24 in the supporting plate 14 of the panel element 10.

In front of the supporting plate 14 and in the immediate vicinity of the visible end 20 of the light conductor 22 is an occulting disc 26 rotatably supported on an axis 23 oriented parallel to the axis of the endpiece 24. Disc 26 has one or more openings such as 30*a*, *b* and *c* (FIG. 3), centered on a circumferential line coinciding with the locus of the longitudinal axis of the endpiece 24 during rotation of the disc, as described more fully below. When one of the openings 30*a*, *b* or *c* is in front of the endpiece 24, the light passes through the disc 26 and produces a visible dot. One or more of the openings, such as openings 30*b* and *c*, may be provided with a colored filter depending upon the desired result, or the opening may remain unobstructed, such as opening 30*a*. When a solid portion of disc 26 is in front of endpiece 24, light passage is blocked and the light dot is invisible from the face plate 16.

Preferably, a number of individual optical fibers, for example, three or four, coming from one or more separate light sources, are terminated in each cell 12. By providing a plurality of fibers which are controlled by each occulting disc 26, the luminosity of the message is increased by the increased number of luminous ends functioning as the same "dot" of the message. Safety and reliability are increased since, in the event of a lamp failure, light from another lamp is still transmitted to the cell to maintain illumination of the message. Further, colored filters may be provided upstream of the fibers, thus increasing the color possibilities of the displayed message.

Depending upon the application for which the occulting device is intended, the motor which controls rotation of the disc may be in different forms. In its simplest form, the motor may be constituted by a permanent magnet secured for rotation with the disc spindle and placed in the air gap of an electromagnet activated by signals from a control logic. The motor must have minimum bulk and, preferably, an exceedingly short response time. Since a typical matrix display incorporates a large number of cells, a long response time for each motor would result in long delays in changing a message on a display. Thus, a short response time for each occulting disc-controlling motor is advantageous and highly desirable, especially in emergency situations when it becomes necessary to change the message as quickly as possible.

A preferred embodiment of a motor 32 will be described for the case of a disc having a single free opening 30*a* which can be placed in one of two positions, as shown in FIG. 4: one coinciding with the longitudinal axis of the endpiece 24, shown in solid lines, and the other in which the disc blocks passage of light from the endpiece. This latter position has the opening 30*a* in the diametric location shown by the broken lines.

Motor 32, shown in simplified form in FIG. 4, has a rotor 34 constituted by a small permanent magnet 36 having a high coercive field, magnetized at poles N, S disposed radially with respect to spindle 38 and rotatable therewith. Occulting disc 26, illustratively shown with a single opening 30*a*, is secured at one end of the spindle 38, and suitable bearings, such as 40, support the spindle for free rotation. In practice, the magnet 36 constituting the rotor may be embodied as a small cylinder to plastoferrite which has been magnetized diametrically.

Stator 42 is constituted by a magnetic circuit made of a material having high remanence, but with a low coercive field. It may have any desired configuration, provided that its two poles 44 and 46 are presented diametrically with respect to the axis of the rotor 34, and is positioned at the same level as the magnet 36. An electrical conductor 48 is wound around the stator 42 in a conventional manner and, by the signals from the control logic (not shown) energizes the stator to alternately change the magnetic polarity of the poles 44 and 46. The stator 42 may be constituted as a single element as shown or may be an assembly of two or more parts, and may have any suitable cross-sectional configuration.

Stationary indexing pins 50 and 52 are provided in the plane of rotation of the magnet 36 of the rotor 34, diametrically opposite from each other and offset with respect to the diametric line joining the stator poles 44 and 46. Thus, an indexing pin is associated with each pole of the stator 42 and is spaced from its respective pole. The indexing pins 50 and 52 may, for example, be simple pins of a magnetically-attractive and non-remanent material, and may conveniently be fixed to the motor housing or frame.

The operation of the motor 32 and the effects of the indexing pins 50, 52 will be described with references to FIGS. 5*a*–5*f*. When the motor 32 is not energized, the stator poles 44, 46 are not magnetized, and the rotor magnet 36 is in a position of equilibrium corresponding to minimal air gap between the poles of the magnet and the stator poles. Assuming that there are no indexing pins, the polar axis of the magnet 36 is aligned with the polar axis joining the poles of the stator 42, the polarity of the magnet being such as to be adjacent to the attractive, opposite polarity of the stator during its prior energization.

The effect of a brief current pulse, typically less than 1 ms, sent by the control logic in one direction or the other through the coil 48 magnetizes the poles 44, 46 of stator 42 which, for the sake of discussion, becomes S and N poles, respectively, producing a magnetic field with substantially parallel lines of force connecting the two poles as shown in FIG. 5*a*. If the respective facing poles of the magnet 36 and the stator 42 are of opposite magnetic polarity, they attract one another and there is no torque generated. The system is in a state of stable equilibrium.

If, however, the stator poles 44, 46 become N and S poles, respectively, due to the first electrical impulse, a magnetic field is produced with lines of force having the same orientation, but of the opposite direction, as shown in FIG. 5*b*. The facing magnet and stator poles are of the same polarity and will tend to repel one another. However, since the lines of force are parallel to the polar axis of the magnet 36, there is again no torque being generated, but the system is in a state of unstable equilibrium. Any force upon the magnet 36, as shown in FIG. 5*c*, will result in the magnet rotating 180 degrees to a position of stable equilibrium, with the direction of the force on the magnet determining the direction of rotation. There is not preferential direction of rotation, and such a motor cannot work on its own.

To allow such a motor to operate, it is necessary to create, for each equilibrium position, a misalignment of the stator lines of force with respect to the polar axis of the magnet. Such a misalignment is created by a mass represented by the indexing pin 50 which is a magnetically non-remanent, magnetically-attractive material supported by the frame or housing of the motor 32 and located at a distance from one of the stator poles, such as pole 46, on the same radius as the stator poles are located from the rotational axis of the magnet 34. Such misalignment is shown in FIG. 5*d* wherein the magnet 34 is attracted partially to the indexing pin 50 and partially by the stator poles 44, 46 to find a stable equilibrium position not aligned with the stator magnetic field. For best mechanical equilibrium, it is preferred to have two magnetically-attractive masses represented by the indexing pins 50 and 52 diametrically opposed, as shown in FIG. 5*e*, corresponding to the configuration shown in FIG. 4.

As soon as an electric pulse of a sign opposite to that of the previous one is provided, the polarity of stator poles 44, 46 are inverted, and the magnetic repulsion of the corresponding poles results in a force component tangential to the axis of the rotor magnet 34 due to the non-alignment of the magnet's polar axis and that of the stator poles, which generates a torque to initiate rotation of the magnet as shown in FIG. 5*f*. The rotor magnet then stabilizes itself in the directly-opposite position since the indexing pins which are magnetically non-remanent, will play the same role regardless of which magnetic pole is presented thereto by the rotor magnet. A further pulse of the opposite sign will make the magnet 36 turn through 180 degrees in the same direction.

The size of the indexing pins 50 and 52 and their position relative to the respective stator pole 44 or 46 is selected such that the magnetic forces between the magnetic rotor poles and the stator poles, with their residual magnetism, may be higher than between the magnetic rotor poles and the indexing pins to prevent any oscillation of the rotor in the region of the pins after the stator has been de-energized.

As noted above, the material of the indexing pins 50 and 52 is magnetically non-remanent, that is, the material has virtually no capacity to retain a residual magnetic field. Thusly, the indexing pins will not acquire the polarity of the adjacent stator pole or rotor magnet pole. In this way, each of the indexing pins will attract whichever rotor pole is presented thereto. Soft iron is one material which is ideally suited for the pins 50 and 52.

As also noted above, the material from which the stator 42 is made is preferably one with a high magnetic remanence and a low coercive field, i.e., high permeability. The low coercive field of the stator material permits the polarity of the stator poles 44 and 46 to be quickly changed by the appropriate signal from the control logic. The high remanence of the stator material permits the stator poles to be rapidly magnetized and to retain a high level of magnetic flux after termination of the energizing pulse. Consequently, the message on the display board, as reflected by the polarity of the stator poles and the adjacent rotor pole, is veritably memorized between series of energizing pulses. One effect of this is the high stability of the motor, or stated otherwise, the lack of oscillation of "hunting" of the rotor about its stable, rest position.

These desirable properties of the stator material results in the stator poles being capable of rapid magnetization with substantially less energizing current than has been possible with prior art devices. Thus, messages on the display matrix can be created and changed rapidly, with a substantial savings in energy required to operate the numerous disc-operating motors. Additionally, the high stability of the rotor results in distinct, flicker-free displays.

Figure 6:
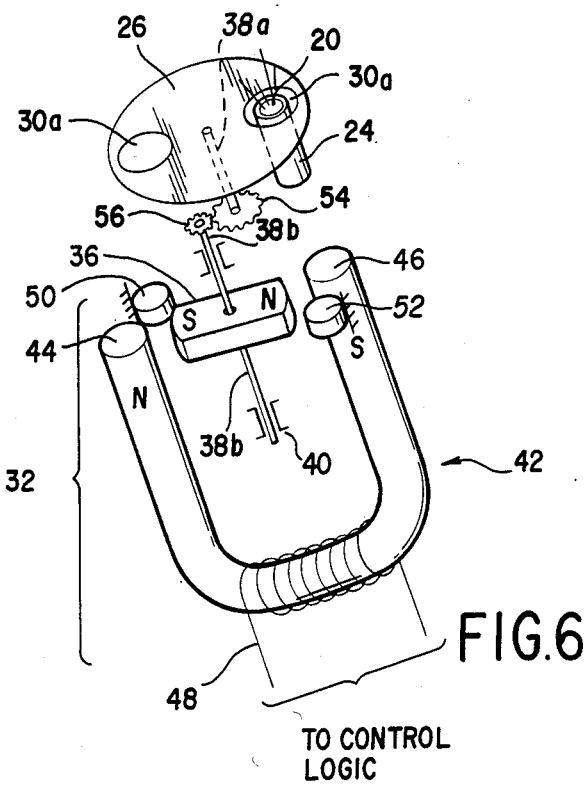
FIG. 6 is a perspective view of an alternate embodiment of the motor of FIG. 4.

If the occulting disc 26 is provided with more than one opening, a gear arrangement is provided to reduce the amount of rotation of the disc due to rotation of the rotor magnet. A reduction gearing arrangement such as shown in FIG. 6 may be incorporated into the motor 32 in which the disc spindle comprises two, separate portions 38*a* and 38*b* coacting through meshing square 54 and 56. By this arrangement, each 180 degrees rotation of the rotor results in less than a 180 degree rotation of the disc 26, the amount of disc rotation being determined by the ratio of the gears 54 and 56.

Figure 7:
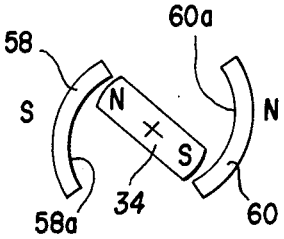
FIG. 7 is a plan view of another embodiment of a motor for operating an occulting disc.

An alternate embodiment of the motor is shown in simplified form in FIG. 7, wherein the assembly constituted by the stator and indexing pins may be replaced by a stator with pole pieces having an eccentric, arcuate configuration relative to the rotor. The functions of the separate stator poles 44, 46 and indexing pins 50, 52 in the motor 32 is achieved by stator poles 58 and 60, each of which has an arcuate inner surface 58*a* and 60*a*, respectively, which is eccentric relative to the rotational axis of the rotor 34. The other elements associated with the motor 32 of FIG. 4 have not been shown in FIG. 7.

The operation of the motor embodiment of FIG. 7 is illustrated in FIGS. 8*a*–8*g*. In the condition shown in FIG. 8*a*, stator poles 58 and 60 are not magnetized, and the magnet rotor 34 is at rest in an equilibrium position corresponding to the point of minimum reluctance where the poles of the magnet lie in the neighborhood of the stator poles which are the nearest to the magnet's rotational axis. Upon the first energizing pulse to the stator, assuming the poles acquire the polarity shown in FIG. 8*b*, a magnetic field is created whose lines of force link the two stator poles as shown. During energization, the magnet 34 initiates a rotation tending to put it in alignment with the magnetic field, as indicated by the arrow. After the pulse, due to the remanence of the stator, there remains a magnetic field, although less strong, between the poles 58, 60 and thus the magnet 34 will find the stable equilibrium position as shown in FIG. 8*c*, somewhere between the points of minimum reluctance and complete alignment with the residual field between the stator poles.

If the first electrical pulse creates the opposite polarity, as shown in FIG. 8*d*, the magnet rotor 34 moves during the pulse in a direction tending to take its poles away from the facing stator pole since if it moved in the opposite direction, it would enter into an increasing antagonistic magnetic field. After the pulse, due to the remanence of the stator, the magnet will find a stable equilibrium position as shown in FIG. 8*e*. When a pulse of opposite sign is passed to the stator, a rotation will be initiated in a direction corresponding to a decreasing antagonistic magnetic field, as shown in FIG. 8*f*, due to the misalignment of the polarity axis of the magnet rotor 34 with respect to the stator field. This rotation continues after the pulse has stopped due to the remanence of the stator, and the rotor stops in a position as shown in FIG. 8*g*.

The control logic controlling the above occulting disc motors is of the known, conventional type, and has not been described in detail.

Among its many features and advantages, the invention provides a display matrix which can operate in a wide range of temperatures, from −30° C. to 110° C.; requires only brief energizing pulses to actuate the occulting disc, thus resulting in substantial energy savings; makes possible the display of a wide variety of messages, in color and in alphanumeric characters, such as "ACCIDENT AT 800 M", as well as pictographs, such as road sign symbols; and because of the very quick response time of the disc operating motors, messages may be quickly created and changed to suit requirements. Moreover, since the functions of occultation and light transmission are separate, the message may be modified by occultation of the optical fibers while the light sources are extinguished. This avoids distraction by the text being modified.

The invention has very broad applications, and finds particular use in the fields of information of a signalization and safety character for all modes of transportation and information of an advertising nature.

While preferred embodiments of the invention have been disclosed, it is obvious that numerous changes and modifications may be made thereto without departing from the spirit and scope of the invention as defined by the appended claims.

What is claimed is:

1. In a display matrix wherein a display is selectively formed by elements of the matrix, each matrix element being formed by the downstream ends of a plurality of optical fibers whose upstream ends are adapted to receive light from a light source, electromechanical occulting means interposed in the path of light between said downstream end of said optical fibers and the front of said matrix and capable of modifying the properties of the light emitted to the front of the matrix in which said optical fibers are associated individually or in very small assemblies with said electromechanical occulting means, and means controlling said occulting means to selectively control the occulting of said associated optical fibers to form the desired display on the front of the matrix, the improvement comprising:

said occulting means comprising a disc disposed in front of said downstream ends of said fibers and rotatable about an axis perpendicular to the surface of said disc, said disc incorporating multiple light modifying sectors capable of being interposed in said path of light as a function of rotation controlled by said control means, said disc being rotated by a rotary motor means having two positions of equilibrium;

said motor means having a rotor rotating freely on a rotor axis and comprised of a small permanent magnet with two poles oriented radially with respect to said rotor axis, and a stator made of a material with good magnetic remanence and high magnetic permeability forming a circuit magnetizable by an electrical pulse and presenting two poles diametrically opposite with respect to said rotor axis; and means adapted to initiate rotation of said rotor at the moment of an electrical pulse energizing said stator, by misaligning said rotor poles relative to said stator poles when said rotor has stopped rotating and said stator is no longer energized by an electrical pulse, said means to misalign comprising said stator having a smooth, continuous inner peripheral surface disposed eccentrically with respect to said rotor and having portions diverging away from said rotor axis, the portions of said stator surface located closest to said rotor axis being locations of minimum magnetic reluctance causing said rotor to stop in a misaligned orientation relative to the stator residual magnetic lines of flux when said stator is no longer being energized by an electrical pulse.

2. The display matrix of claim 1, wherein said disc includes, between two light occulting sectors, a sector capable of modifying the color of said light emitted to the front of the matrix.

3. The display matrix of claim 1, wherein said disc includes, between two light occulting sectors, a sector capable of modifying the intensity of said light emitted to the front of the matrix.

4. The display matrix of claim 1, wherein said disc is connected to said motor by a reducing gear.

5. In a display matrix wherein a display is selectively formed by elements of the matrix, each matrix element being formed by the downstream ends of a plurality of optical fibers whose upstream ends are adapted to receive light from a light source, electromechanical occulting means interposed in the path of light between said downstream end of said optical fibers and the front of said matrix and capable of modifying the properties of the light emitted to the front of the matrix, in which the optical fibers are associated individually or in very small assemblies with said electromechanical occulting means, and means controlling said occulting means to selectively control the occulting of said associated optical fibers to form the desired display on the front of the matrix, the improvement comprising:

said occulting means comprising a disc disposed in front of said downstream ends of said fibers and rotatable about an axis perpendicular to the surface of said disc, said disc incorporating multiple light-modifying sectors capable of being interposed in said path of light as a function of rotation controlled by said control means, said disc being rotated by a rotary motor means having two positions of equilibrium;

said motor means having a rotor rotating freely on a rotor axis and comprised of a small permanent magnet with two poles oriented radially with respect to said rotor axis, and a stator made of a material with good magnetic remanence and high magnetic permeability, forming a circuit magnetizable by an electrical pulse, and presenting two poles diametrically opposite with respect to the axis of said rotor axis; and means adapted to initiate rotation of said rotor at the moment an electrical pulse energizes said stator comprising two magnetically-attractive indexing pins, each stationarily located at an equal distance on opposite sides of each of said stator poles, such that a line passing through said pins is offset from a second line passing through said stator poles, said pins being of a magnetically non-remanent material.

6. The display matrix of claim 5, wherein said disc includes, between two light occulting sectors, a sector capable of modifying the color of said light emitted to the front of the matrix.

7. The display matrix of claim 5, wherein said disc includes, between two light occulting sectors, a sector capable of modifying the intensity of said light emitted to the front of the matrix.

8. The display matrix of claim 5, wherein said disc is connected to said motor by a reducing gear.

* * * * *